US010249254B2

(12) United States Patent
Omid-Zohoor et al.

(10) Patent No.: US 10,249,254 B2
(45) Date of Patent: Apr. 2, 2019

(54) DEVICES AND METHODS FOR DISCHARGING OR HARVESTING VCOM CHARGE IN ELECTRONIC DISPLAYS

(71) Applicant: Apple Inc., Cupertino, CA (US)

(72) Inventors: Kasra Omid-Zohoor, San Francisco, CA (US); Hyunwoo Nho, Stanford, CA (US); Keitaro Yamashita, Cupertino, CA (US); Majid Gharghi, Cupertino, CA (US); Sarath Chandrasekhar Venkatesh Kumar, Cupertino, CA (US); Ting-Kuo Chang, Cupertino, CA (US); Abbas Jamshidi Roudbari, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 115 days.

(21) Appl. No.: 15/007,016

(22) Filed: Jan. 26, 2016

(65) Prior Publication Data

US 2017/0084243 A1 Mar. 23, 2017

Related U.S. Application Data

(60) Provisional application No. 62/221,503, filed on Sep. 21, 2015.

(51) Int. Cl.
*G09G 5/00* (2006.01)
*G09G 3/36* (2006.01)

(52) U.S. Cl.
CPC ... *G09G 3/3659* (2013.01); *G09G 2300/0819* (2013.01); *G09G 2300/0852* (2013.01); *G09G 2300/0876* (2013.01); *G09G 2310/0251* (2013.01); *G09G 2320/0257* (2013.01); *G09G 2330/027* (2013.01)

(58) Field of Classification Search
CPC ..... G09G 3/3659; G09G 2300/0876; G09G 2300/0852; G09G 2330/027; G09G 2320/0257; G09G 2300/0819; G09G 2310/0251
See application file for complete search history.

(56) References Cited

U.S. PATENT DOCUMENTS

| | | | | |
|---|---|---|---|---|
| 6,515,644 | B1 * | 2/2003 | Kim | G02F 1/136204 345/87 |
| 8,040,326 | B2 | 10/2011 | Hotelling et al. | |
| 8,072,408 | B2 | 12/2011 | Fujikura | |
| 8,760,606 | B2 | 6/2014 | Allemand et al. | |
| 9,082,338 | B2 | 7/2015 | Yaras et al. | |
| 2009/0009446 | A1 * | 1/2009 | Kamijo | G09G 3/3655 345/87 |

(Continued)

*Primary Examiner* — Adam R. Giesy
(74) *Attorney, Agent, or Firm* — Fletcher Yoder PC

(57) ABSTRACT

Methods and devices useful in discharging an aberrant charge on the VCOM of an electronic display and harvesting energy from the VCOM of the electronic display are provided. By way of example, a method may include supplying an activation signal to an active switching device of an electronic display. The active switching device is configured to discharge an aberrant charge on a common electrode of the electronic display. The method further includes discharging the aberrant charge by way of the active switching device. Discharging the aberrant charge comprises preventing a possible occurrence of image artifacts from becoming apparent on the electronic display.

30 Claims, 12 Drawing Sheets

(56) References Cited

U.S. PATENT DOCUMENTS

| | | | | |
|---|---|---|---|---|
| 2009/0160826 | A1* | 6/2009 | Miller | G09G 3/3291 345/204 |
| 2011/0050756 | A1 | 3/2011 | Cassidy et al. | |
| 2015/0109282 | A1* | 4/2015 | Chen | G09G 3/3677 345/212 |

* cited by examiner

DEVICES AND METHODS FOR DISCHARGING OR HARVESTING VCOM CHARGE IN ELECTRONIC DISPLAYS

CROSS REFERENCE TO RELATED APPLICATIONS

This application is a Non-Provisional patent application of U.S. Provisional Patent Application No. 62/221,503, entitled "Devices and Methods for Discharging or Harvesting VCOM Charge in Electronic Displays", filed Sep. 21, 2015, which is herein incorporated by reference in its entirety and for all purposes.

BACKGROUND

The resent disclosure relates generally to electronic displays and, more particularly, to electronic displays with reduced or eliminated mura artifacts or to recovering charge buildup on display for useful purposes.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays may be found in a variety of devices, such as computer monitors, televisions, instrument panels, mobile phones, clocks, wearable devices, virtual reality (VR) devices, automobiles, and so forth. One type of electronic display, known as a liquid crystal display (LCD), displays images by modulating the amount of light allowed to pass through a liquid crystal layer within pixels of the LCD. In general, LCDs modulate the light passing through each pixel by varying a voltage difference between a pixel electrode and a common electrode (VCOM). This creates an electric field that causes the liquid crystal layer to change alignment. The change in alignment of the liquid crystal layer causes more or less light to pass through the pixel. By changing the voltage difference supplied to each pixel, images are produced on the LCD.

Another type of electronic display, known as an organic light-emitting diode (OLED) display, which may include light-emitting devices including one or more layers of organic materials interposed between a pixel electrode and a common electrode (VCOM). Specifically, the OLED display may display images by driving individual OLED pixels to store image data and image brightness data. In either case of LCDs or OLEDs, bias voltages or other voltage perturbations coupling to the VCOM could produce visible artifacts known as muras or flicker. Furthermore, for certain displays such as, for example, displays in mobile phones, wearable devices, VR devices, or automobile heads-up displays (HUDs), VCOM voltage may couple to one or more sources of electromagnetic radiation. It may be useful to provide electronic displays with reduced or eliminated mura or flicker artifacts.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Various embodiments of the present disclosure relate to methods and devices for discharging an aberrant charge on the common voltage electrode (VCOM) of an electronic display. By way of example, a method may include supplying an activation signal to an active switching device of an electronic display. The active switching device is configured to discharge an aberrant charge on a common electrode of the electronic display. The method further includes discharging the aberrant charge by way of the active switching device. Discharging the aberrant charge comprises preventing a possible occurrence of image artifacts from becoming apparent on the electronic display.

Embodiments of the present disclosure relate to methods and devices for harvesting energy from the VCOM of an electronic display. By way of example, a method may include receiving one or more inputs from a common electrode of an electronic display based on an aberrant charge on the common electrode, converting the one or more inputs based on the aberrant charge into a useable energy, and storing or utilizing the useable energy to power one or more functions of the electronic display.

Various refinements of the features noted above may exist in relation to various aspects of the present disclosure. Further features may also be incorporated in these various aspects as well. These refinements and additional features may exist individually or in any combination. For example, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
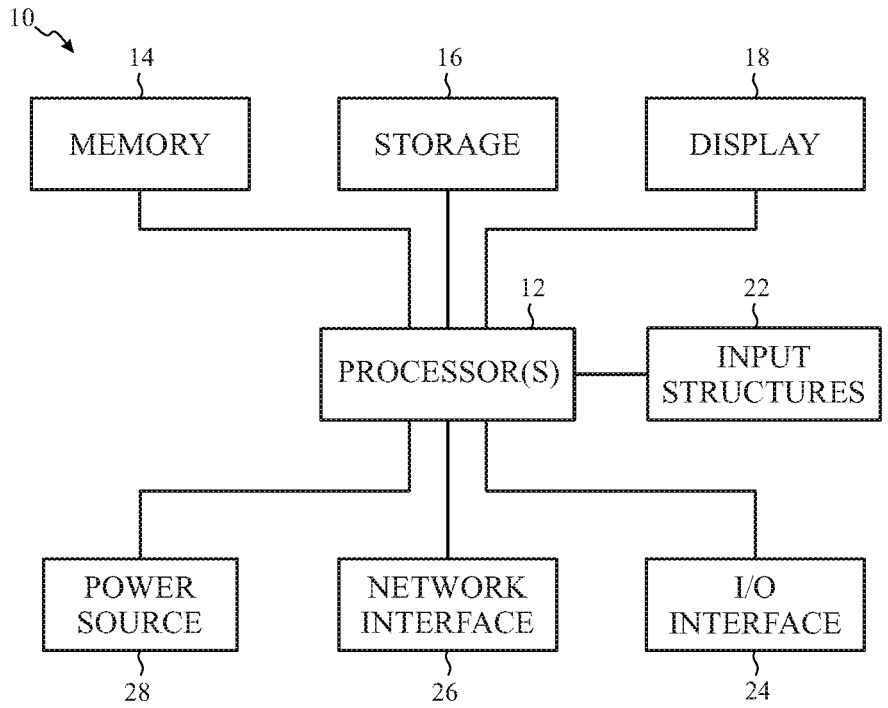
FIG. 1 is a schematic block diagram of an electronic device including a display, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of the present disclosure relate to methods and devices for discharging an aberrant charge on the common voltage electrode (VCOM) of an electronic display and harvesting energy from the VCOM of the electronic display (e.g., a VCOM of a liquid crystal display (LCD) or an organic light-emitting diode (OLED) display). Indeed, the present embodiments may include technique of placing a first active switch (e.g., transistor) across the pixel electrode and common electrode of pixels of the electronic display. The gate of the first active switch may be coupled to a voltage source (e.g., high direct current (DC) voltage output) of charge pump circuitry that may be used to collect energy from one or more disturbance charges (e.g., due to a user touch of the electronic display and/or electromagnetic interference (EMI)) appearing on the VCOM of the electronic display. Specifically, the first active switch may be used to provide a discharge path from the VCOM to the data line of the electronic display to discharge the aberrant charge when the electronic display is "OFF" (e.g., deactivated or temporarily inactive).

In some embodiments, the present techniques may also include providing a second active switch (e.g., pull-down transistor) coupled to the gate of the first active switch. The second active switch may be used to pull the voltage of the gate of the first active switch to ground (e.g., approximately 0 volts (V)) when the electronic display "ON" (e.g., activated). In other embodiments, the present techniques may include providing a multiplexer (MUX) to select between a gate signal of a thin-film transistor (TFT) of a pixel of the electronic display and the voltage source (e.g., high direct current (DC) voltage output) of charge pump circuitry to discharge the aberrant charge when the electronic display is "OFF" (e.g., deactivated or temporarily inactive). Specifically, the MUX may select the gate signal when the electronic display "ON" (e.g., activated), and select the voltage source signal when the electronic display is "OFF" (e.g., deactivated or temporarily inactive. In this way, the possibility of image artifacts becoming apparent on the electronic display due to the aberrant charge may be reduced or substantially eliminated. Furthermore, in some embodiments, the aberrant charge on the VCOM may be stored or utilized to power one or more functions of the electronic display or of an electronic device encompassing the electronic display.

With the foregoing in mind, a general description of suitable electronic devices that may include a display and data processing circuitry useful in discharging an aberrant charge on the VCOM of an electronic display and harvesting energy from the VCOM of the electronic display is provided. Indeed, while the present embodiments may be discussed henceforth with respect to embodiments of a notebook computer 30A, a handheld device 30B, handheld device 30C, a computer 30D, and wearable electronic device 30E, it should be appreciated that the present techniques may be applied in any of various electronic displays such as, for example, electronic displays utilized in virtual reality (VR) and/or augmented reality (AR) systems and devices, head-up displays (HUDs) utilized in automobiles and other similar systems, head-mounted displays (HMDs), as well as numerous other technologies utilizing various forms of electronic displays.

Turning first to FIG. 1, an electronic device 10 according to an embodiment of the present disclosure may include, among other things, one or more processor(s) 12, memory 14, nonvolatile storage 16, a display 18 input structures 22, an input/output (I/O) interface 24, network interfaces 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in electronic device 10.

Figure 2:
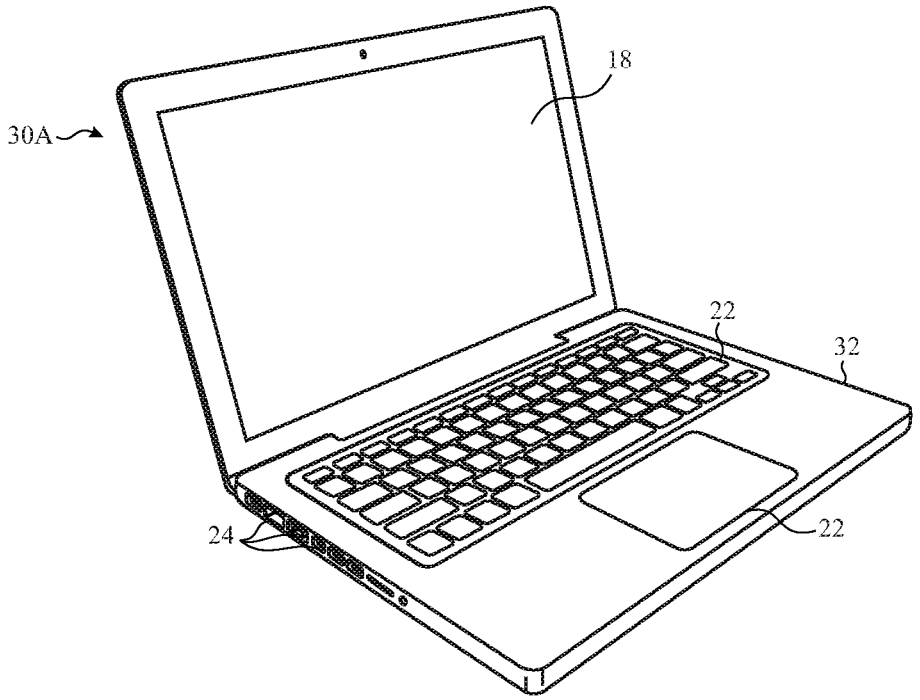
FIG. 2 is a perspective view of a notebook computer representing an embodiment of the electronic device of FIG. 1.
Figure 3:
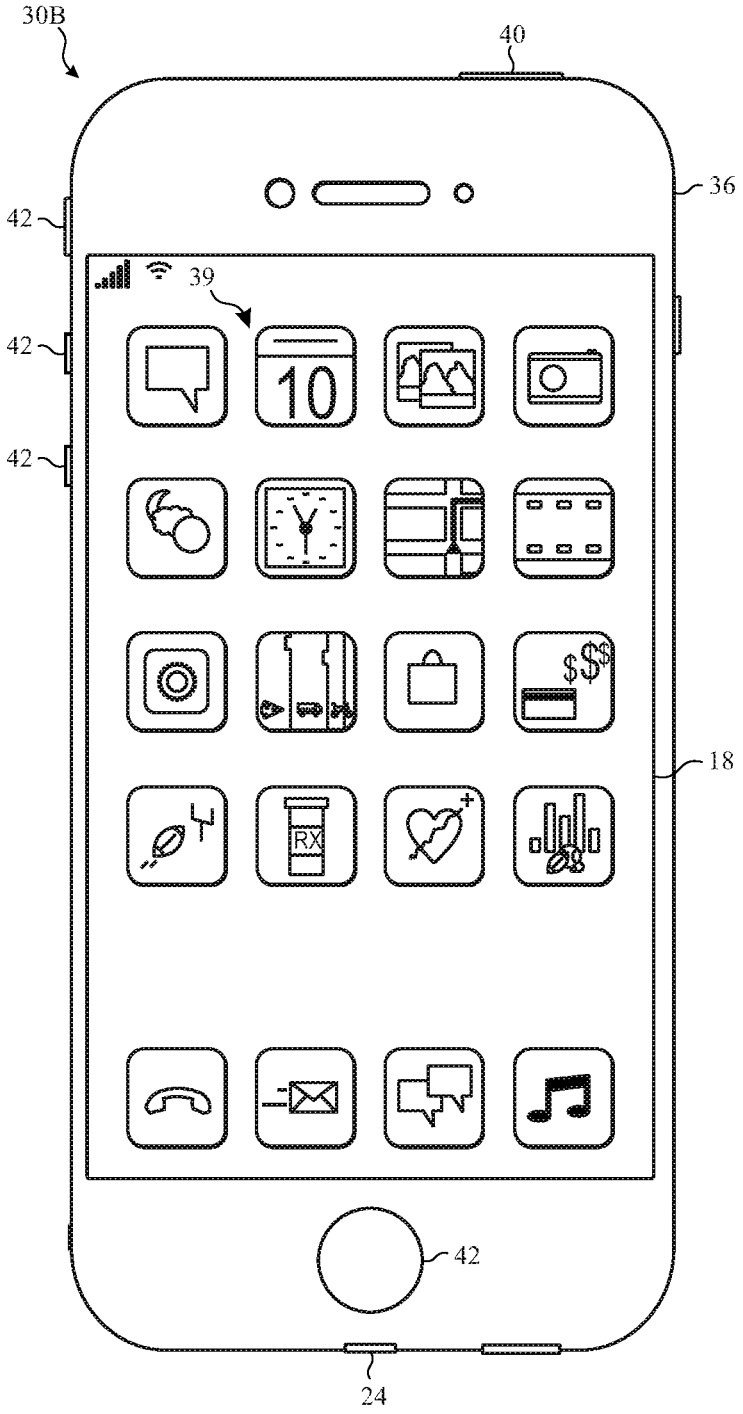
FIG. 3 is a front view of a hand-held device representing another embodiment of the electronic device of FIG. 1.
Figure 4:
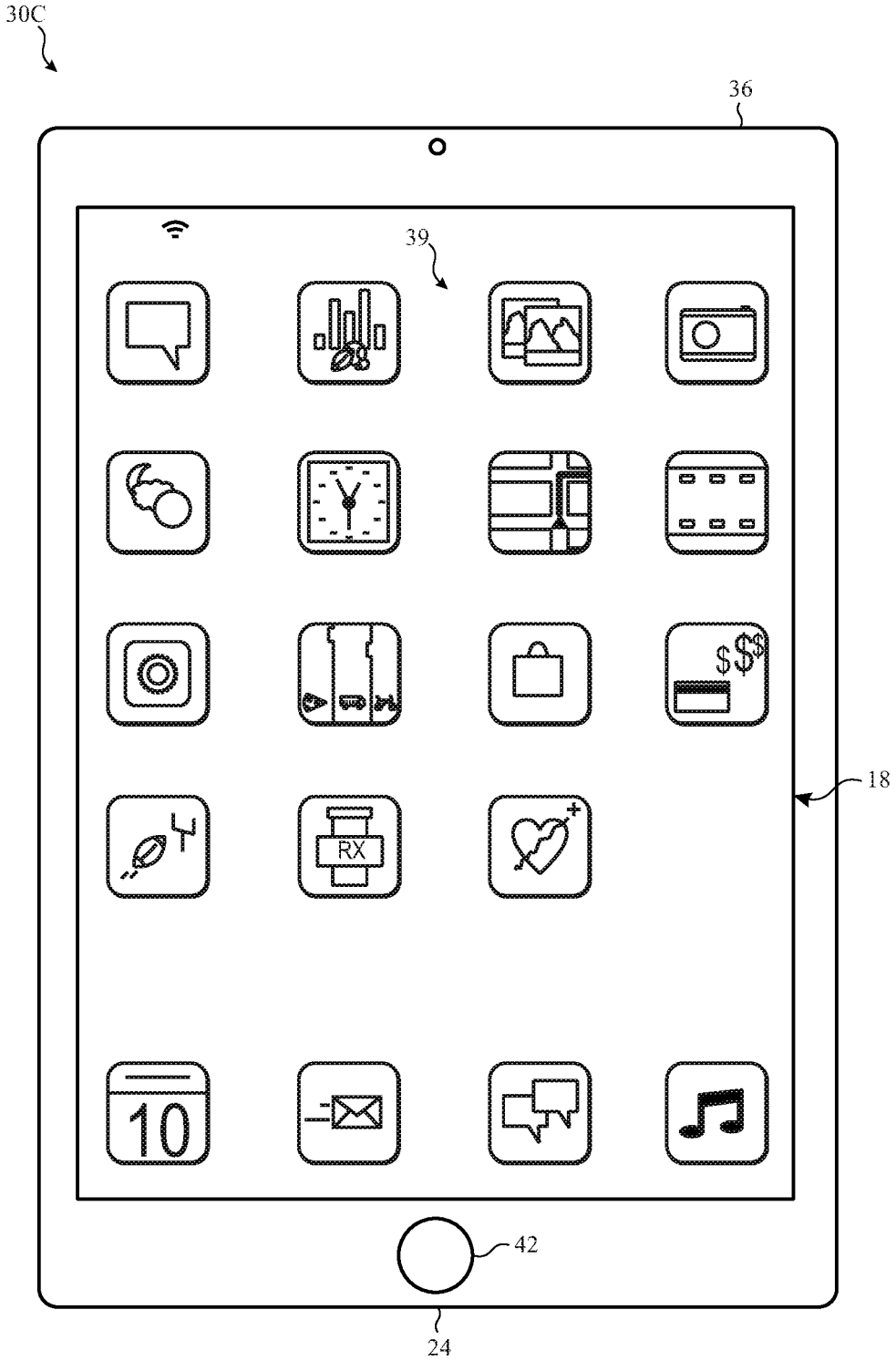
FIG. 4 is a front view of another hand-held device representing another embodiment of the electronic device of FIG. 1.
Figure 5:
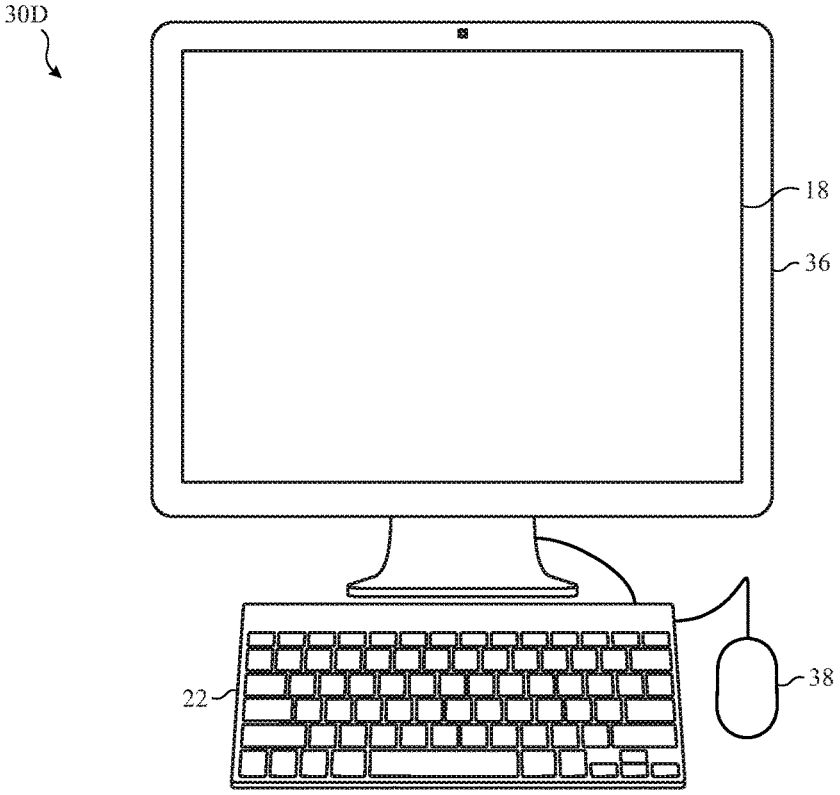
FIG. 5 is a front view of a desktop computer representing another embodiment of the electronic device of FIG. 1.

By way of example, the electronic device 10 may represent a block diagram of the notebook computer depicted in FIG. 2, the handheld device depicted in FIG. 3, the desktop computer depicted in FIG. 4, the wearable electronic device depicted in FIG. 5, or similar devices. It should be noted that the processor(s) 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor(s) 12 and/or other data processing circuitry may be operably coupled with the memory 14 and the nonvolatile memory 16 to perform various algorithms. Such programs or instructions executed by the processor(s) 12 may be stored in any suitable article of manufacture that may include one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor(s) 12 to enable the electronic device 10 to provide various functionalities.

In certain embodiments, the display 18 may be a liquid crystal display (LCD), which may allow users to view images generated on the electronic device 10. In some embodiments, the display 18 may include a touch screen, which may allow users to interact with a user interface of the electronic device 10. Furthermore, it should be appreciated that, in some embodiments, the display 18 may include one or more organic light emitting diode (OLED) displays, or some combination of LCD panels and OLED panels. Further, in some embodiments, the display 18 may include a light source (e.g., backlight) that may be used to emit light to illuminate displayable images on the display 18. Indeed, in some embodiments, as will be further appreciated, the light source (e.g., backlight) may include any type of suitable lighting device such as, for example, cold cathode fluorescent lamps (CCFLs), hot cathode fluorescent lamps (HCFLs), and/or light emitting diodes (LEDs), or other light source that may be utilize to provide highly backlighting.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interfaces 26. The network interfaces 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a $3^{rd}$ generation (3G) cellular network, $4^{th}$ generation (4G) cellular network, or long term evolution (LTE) cellular network. The network interface 26 may also include interfaces for, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra Wideband (UWB), alternating current (AC) power lines, and so forth.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30A, is illustrated in FIG. 2 in accordance with one embodiment of the present disclosure. The depicted computer 30A may include a housing or enclosure 32, a display 18, input structures 22, and ports of an I/O interface 24. In one embodiment, the input structures 22 (such as a keyboard and/or touchpad) may be used to interact with the computer 30A, such as to start, control, or operate a GUI or applications running on computer 30A. For example, a keyboard and/or touchpad may allow a user to navigate a user interface or application interface displayed on display 18.

FIG. 3 depicts a front view of a handheld device 30B, which represents one embodiment of the electronic device 10. The handheld device 34 may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif.

The handheld device 30B may include an enclosure 36 to protect interior components from physical damage and to shield them from electromagnetic interference. The enclosure 36 may surround the display 18, which may display indicator icons 39. The indicator icons 39 may indicate, among other things, a cellular signal strength, Bluetooth connection, and/or battery life. The I/O interfaces 24 may open through the enclosure 36 and may include, for example, an I/O port for a hard wired connection for charging and/or content manipulation using a standard connector and protocol, such as the Lightning connector provided by Apple Inc., a universal service bus (USB), or other similar connector and protocol.

User input structures 42, in combination with the display 18, may allow a user to control the handheld device 30B. For example, the input structure 40 may activate or deactivate the handheld device 30B, the input structure 42 may navigate user interface to a home screen, a user-configurable application screen, and/or activate a voice-recognition feature of the handheld device 30B, the input structures 42 may provide volume control, or may toggle between vibrate and ring modes. The input structures 42 may also include a microphone may obtain a user's voice for various voice-related features, and a speaker may enable audio playback and/or certain phone capabilities. The input structures 42 may also include a headphone input may provide a connection to external speakers and/or headphones.

FIG. 4 depicts a front view of another handheld device 30C, which represents another embodiment of the electronic device 10. The handheld device 30C may represent, for example, a tablet computer, or one of various portable computing devices. By way of example, the handheld device 30C may be a tablet-sized embodiment of the electronic device 10, which may be, for example, a model of an iPad® available from Apple Inc. of Cupertino, Calif.

Turning to FIG. 5, a computer 30D may represent another embodiment of the electronic device 10 of FIG. 1. The computer 30D may be any computer, such as a desktop computer, a server, or a notebook computer, but may also be a standalone media player or video gaming machine. By way of example, the computer 30D may be an iMac®, a MacBook®, or other similar device by Apple Inc. It should be noted that the computer 30D may also represent a personal computer (PC) by another manufacturer. A similar enclosure 36 may be provided to protect and enclose internal components of the computer 30D such as the display 18. In certain embodiments, a user of the computer 30D may interact with the computer 30D using various peripheral input devices, such as the input structures 22 or mouse 38, which may connect to the computer 30D via a wired and/or wireless I/O interface 24.

Figure 6:
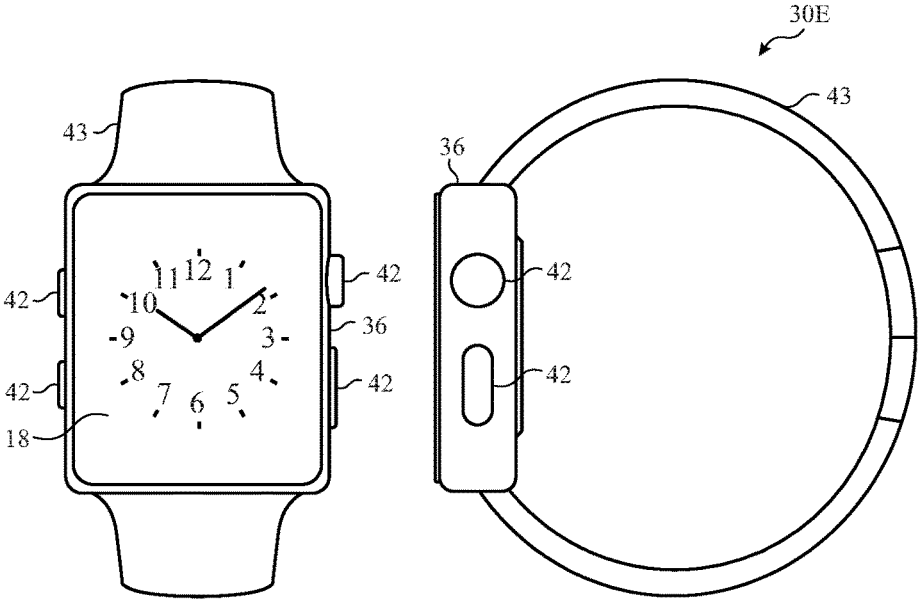
FIG. 6 is a front view of a wearable electronic device representing another embodiment of the electronic device of FIG. 1.

Similarly, FIG. 6 depicts a wearable electronic device 30E representing another embodiment of the electronic device 10 of FIG. 1 that may be configured to operate using the techniques described herein. By way of example, the wearable electronic device 30E, which may include a wristband 43, may be an Apple Watch® by Apple, Inc. However, in other embodiments, the wearable electronic device 30E may include any wearable electronic device such as, for example, a wearable exercise monitoring device (e.g., pedometer, accelerometer, heart rate monitor), or other device by another manufacturer. The display 18 of the wearable electronic device 30E may include a touch screen (e.g., LCD, OLED display, active-matrix organic light emitting diode (AMOLED) display, and so forth), which may allow users to interact with a user interface of the wearable electronic device 30E.

In certain embodiments, as previously noted above, each embodiment (e.g., notebook computer 30A, handheld device 30B, handheld device 30C, computer 30D, and wearable electronic device 30E) of the electronic device 10 may include a display 18. Indeed, as will be further appreciated with respect to FIGS. 7-19, in order to reduce or substantially eliminate the possible occurrence of image artifacts (e.g., image flicker) due to certain disturbance charges (e.g., due to a user touch of the display 18 and/or EMI) and reduce power consumption of the display 18, it may be useful to provide techniques of utilizing an additional switching device in the unit pixels to provide a direct current (DC) voltage used to discharge the VCOM and, further, techniques to harvest any disturbance charge from the VCOM to be converted into usable energy for the display 18 and/or electronic device 10.

Figure 7:
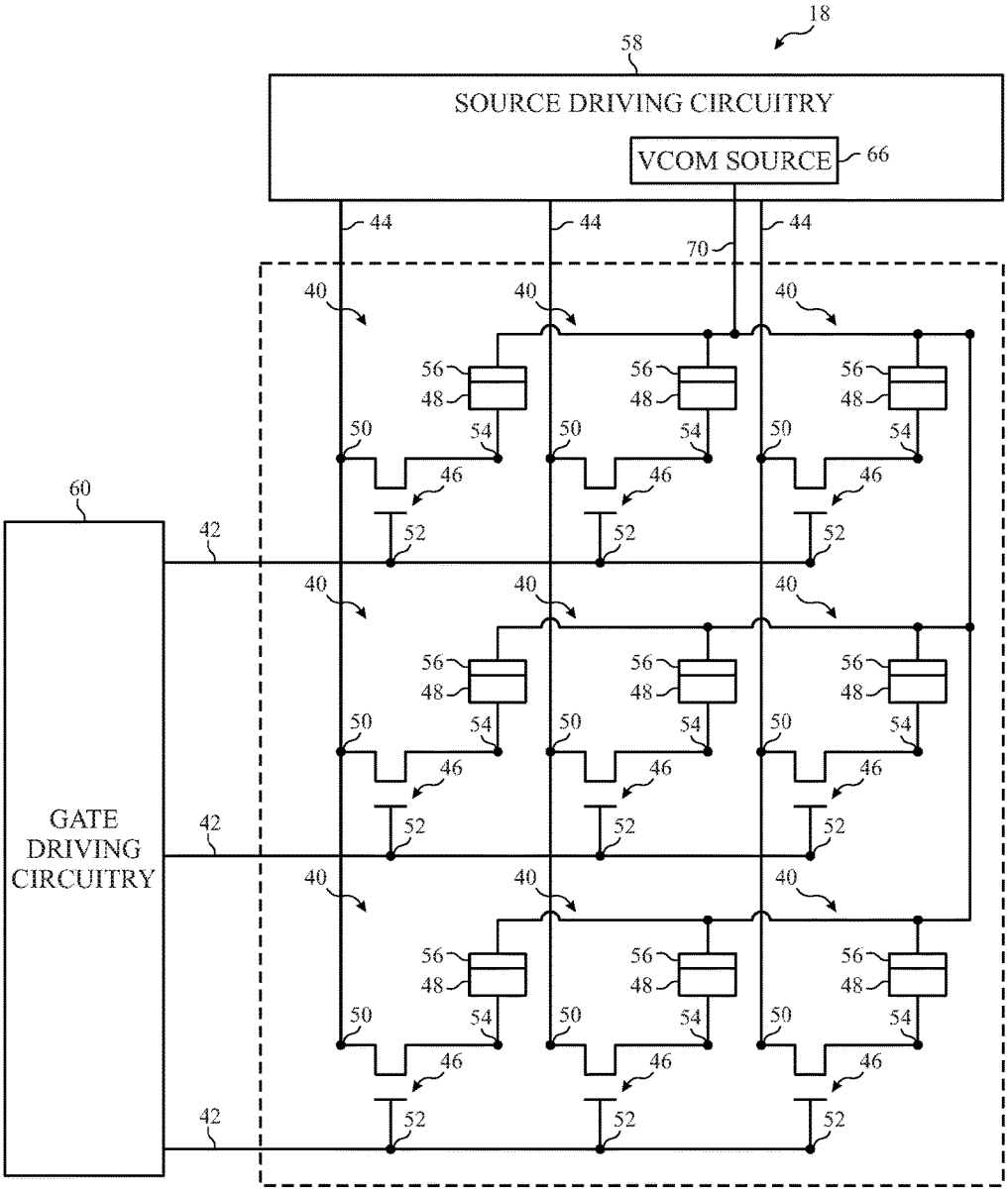
FIG. 7 is a circuit diagram of switching a display circuitry of pixels, in accordance with an embodiment.
Figure 8:
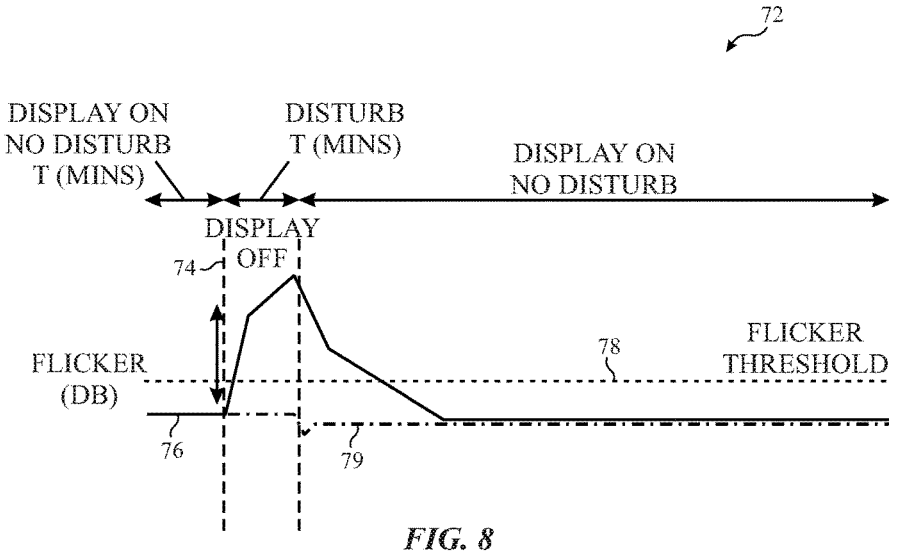
FIG. 8 is a timing diagram illustrating image flicker as a function of time, in accordance with an embodiment.

Turning now to FIG. 7, a circuit diagram of the display 18 is illustrated, in accordance with an embodiment. As shown, the display 18 may include a display panel, such as a liquid crystal display (LCD) panel. The display 18 may include multiple unit pixels 40 disposed in a pixel array or matrix defining multiple rows and columns of unit pixels that collectively form an image viewable region of the display 18. In such an array, each unit pixel 40 may be defined by the intersection of rows and columns, represented here by the illustrated gate lines 42 (also referred to as "scanning lines") and source lines 44 (also referred to as "data lines"), respectively.

Although only nine unit pixels, referred to individually by the reference numbers 40, respectively, are shown for purposes of illustration, it should be understood that in an actual implementation, each source line 44 and gate line 42 may include hundreds, thousands, or millions of such unit pixels 40. By way of example, in a color display 18 having a display resolution of 1024×768, each source line 44, which may define a column of the pixel array, may include 768 unit pixels, while each gate line 42, which may define a row of the pixel array, may include 1024 groups of unit pixels, wherein each group may include a red, blue, and green pixel, thus totaling 3072 unit pixels per gate line 42.

Although a display resolution of 1024×768 is mentioned by way of example above, the display 18 may include any suitable number of pixels. As may be appreciated, in the context of LCDs, the color of a particular unit pixel generally depends on a particular color filter that is disposed over a liquid crystal layer of the unit pixel. In the presently illustrated example, the group of unit pixels 40*a*-40*c* may represent a group of pixels having a red pixel (40*a*), a blue pixel (40*b*), and a green pixel (40*c*). The group of unit pixels 40*d*-40*f* may be arranged in a similar manner.

As shown in the present embodiment, each unit pixel 40 may include a thin film transistor (TFT) 46 for switching a respective pixel electrode 48. In the depicted embodiment, the source 50 of each TFT 46 may be electrically connected to a source line 44. Similarly, the gate 52 of each TFT 46 may be electrically connected to a gate line 42. Furthermore, the drain 54 of each TFT 46 may be electrically connected to a respective pixel electrode 48. Each TFT 46 serves as a switching element which may be activated (e.g., turned "ON" or is active) and deactivated (e.g., turned "OFF" or is temporarily inactive) for a predetermined period based upon the respective presence or absence of a scanning signal at the gate 52 of the TFT 46.

For example, when activated, the TFT 46 may store the image signals received via a respective source line 44 as a charge its corresponding pixel electrode 48. The image signals stored by pixel electrode 48 may be used to generate an electrical field between the respective pixel electrode 48 and a common voltage electrode 56 (VCOM). As discussed above, the pixel electrode 48 and the common electrode 56 may form a liquid crystal capacitor for a given unit pixel 40. Thus, in an LCD display 18, such an electrical field may align liquid crystals molecules within a liquid crystal layer to modulate light transmission through a region of the liquid crystal layer that corresponds to the unit pixel 40. For example, light may be transmitted through the unit pixel 40 at an intensity corresponding to the applied voltage (e.g., from a corresponding source line 44).

The display 18 also may include a source driver integrated circuit (IC) 58 (e.g., column driver), which may include a chip, such as a processor or ASIC, that is configured to control various aspects of display 18 and panel 30. For example, the source driver IC 58 may receive image data from the processor(s) 12 and send corresponding image signals to the unit pixels 40 of the display 18. The source driver IC 58 may also be coupled to a gate driver IC 60, which may be configured to activate or deactivate rows of unit pixels 40 via the gate lines 42. As such, the source driver IC 58 may send timing information to gate driver IC 60 to facilitate activation and/or deactivation of individual rows of pixels 40.

In other embodiments, timing information may be provided to the gate driver IC 60 in some other manner. While the illustrated embodiment shows only a single source driver IC 58 coupled to display 18 for purposes of simplicity, it should be appreciated that additional embodiments may utilize multiple source driver ICs 58 for providing image signals to the pixels 40. For example, additional embodiments may include multiple source driver ICs 58 disposed along one or more edges of the display 18, in which each source driver IC 58 is configured to control a subset of the source lines 44 and/or gate lines 42.

In certain embodiments, the source driver IC 58 may receive image data from the processor(s) 12, and, based on the received data, outputs signals to control the pixels 40. For example, to display image data, the source driver IC 58 may adjust the voltage of the pixel electrodes 48 one row at a time. To access an individual row of pixels 40, the gate driver IC 60 may send an activation signal to the TFTs 46 associated with the particular row of pixels 40 being addressed. This activation signal may render the TFTs 46 on the addressed row conductive. Accordingly, image data corresponding to the addressed row may be transmitted from source driver IC 58 to each of the unit pixels 40 within the addressed row via respective source lines 44. Thereafter, the gate driver IC 60 may deactivate the TFTs 46 in the addressed row, thereby impeding the pixels 40 within that row from changing state until the next time they are addressed. The above-described process may be repeated for each row of pixels 40 in the display 18 to reproduce image data as a viewable image on the display 18.

In some embodiments, the common electrode 56 of the display 18 may include one or more common voltage electrode (VCOM) plates 64. This arrangement may produce separate groups of pixels that are each associated with a different VCOM plate 64. For example, FIG. 7 depicts a common electrode plate 64 associated with nine unit pixels 40, though it should be appreciated that the common electrode plates 64 may be associated with any suitable number of pixels. The source driver IC 58 and the gate driver IC 60 are coupled to the unit pixels 40 by the source lines 44 and the gate lines 42, respectively, as described above. Further, the source driver IC 58 may include a VCOM source 66 that provides a common voltage ($V_{COM}$) via a common voltage line 70. While a single VCOM plate 64 is illustrated, it should be appreciated that the display 18 may include multiple VCOM plates 64 and that the VCOM source 66 may be coupled to each of the VCOM plates 64 by one or more common voltage lines 70.

In certain embodiments, when the display 18 is in the "OFF" mode (e.g., deactivated or temporarily inactive), any charge disturbance signal (e.g., which may be due to a user touch, EMI, and so forth) coupling, for example, to the VCOM plate 64 may cause image artifacts (e.g., flicker or other mura artifacts) to become apparent on the display 18. For example, as illustrated by the timing diagram 72 of FIG. 8, when a disturbance charge is detected or becomes apparent on the display 18 at, for example, time period 74, a charge signal 76 may rise above an acceptable flicker threshold level 78 when the display 18 switches from "OFF" (e.g., deactivated or temporarily inactive) to "ON" (e.g., active). Furthermore, while the display 18 may be kept "ON" to allow the display 18 to discharge the VCOM plate 64 through, for example, the pixels 40, this may increase the power consumption of the source driver 58, and, by extension, the power consumption of the display 18 and the electronic device 10.

Thus, as will described in further detail below, it may be useful to provide techniques for discharging any disturbance charge and/or other aberrant charge on the VCOM plate 64 and/or common electrode 56 of the display 18, and, further, techniques to harvest any disturbance charge or other aberrant charge from the VCOM plate 64 and/or common electrode 56 to be converted into usable energy for the display 18 or the electronic device 10. For example, by applying the presently disclosed techniques, a charge signal 79 may remain below the acceptable flicker threshold level 78 when the display 18 switches from "OFF" (e.g., deactivated or temporarily inactive) to "ON" (e.g., active).

Discharging of Aberrant Charge on VCOM

Figure 9:
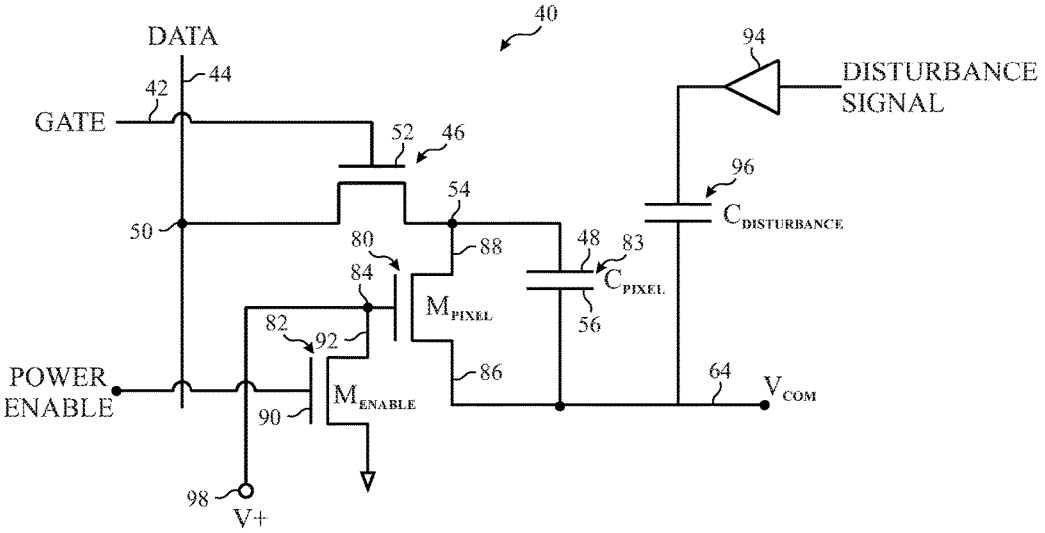
FIG. 9 is an equivalent circuit diagram illustrating of a unit pixel of the display of FIG. 1 including active switches, in accordance with an embodiment.

Turning now to FIG. 9, which illustrates an embodiment of a circuit diagram (e.g., equivalent circuit) of a unit pixel 40 of the display 18 including, for example, active switches 80 and 82 that may be used to discharge the VCOM plate 64 and/or the common electrode 56 to, for example, the data line 44. As depicted, the pixel 40 may include a TFT 46, as previously discussed above with respect to FIG. 7. The active switches 80 and 82 may include any suitable active switching devices (e.g., one or more specific transistors or other solid-state switching devices) useful in controlling the charge on the VCOM plate 64, and by extension, the charge on the common electrode 56. In certain embodiments, the active switch 80 (e.g., "$M_{pixel}$") may be coupled across the pixel capacitance 83 (e.g., $C_{Pixel}$ coupled an led across the pixel electrode 48 and the common electrode 56). Indeed, the active switch 80 (e.g., "$M_{Pixel}$") may be provided to discharge the VCOM plate 64, such that any disturbance charge (e.g., due to a user touch or other disturbance generated via a touch drive amplifier 94) or other aberrant charge may be discharged to the data line 44, and thus the possibility of image artifacts becoming apparent on the display 18 may be reduced or substantially eliminated.

For example, in certain embodiments, when a disturbance charge (e.g., as illustrated by the capacitance 96 ("$C_{Disturbance}$")) is detected or becomes apparent on the VCOM plate 64, the active switch 80 may turn "ON" (e.g., activate). Specifically, when any disturbance charge or other aberrant charge accumulates on the VCOM plate 64, current may flow into the pixel capacitance 83 (e.g., $C_{Pixel}$ coupled across the pixel electrode 48 and the common electrode 56). Thus, a voltage may accumulate across the pixel capacitance 83 until the pixel capacitance 83 becomes completely charged. However, by activating the active switch 80 (e.g., "$M_{Pixel}$"), the active switch 80 (e.g., "$M_{Pixel}$") may turn "ON" and act, for example, as a short circuit path (e.g., operate in the saturation mode) through which current may flow across a first terminal 86 to a second terminal 88 of the active switch 80, and finally through the TFT 46 to the data line 44. Thus, the active switch 80 (e.g., "$M_{Pixel}$") may discharge the VCOM plate 64 during the time the display 18 is "OFF."

In some embodiments, the active switch 82 (e.g., "$M_{Enable}$") may be provided to control the operation of the active switch 80 (e.g., "$M_{Pixel}$"), and more specifically, control when the active switch 80 (e.g., "$M_{Pixel}$") turns "ON" and turns "OFF." For example, in some embodiments, the active switch 82 (e.g., "$M_{Enable}$") may receive a "Power Enable" signal (e.g., direct current (DC) voltage signal or other voltage signal) that may be used to turn "ON" of the active switch 82. Once "ON" (e.g., activated), the active switch 82 (e.g., "$M_{Enable}$") may provide a signal to the gate 84 of the active switch 80 (e.g., "$M_{Pixel}$") to activate the active switch 80 (e.g., "$M_{Pixel}$").

For example, in one embodiment, the active switch 82 (e.g., "$M_{Enable}$") may be a pull-down transistor positioned at the gate 84 of the active switch 80 (e.g., "$M_{Pixel}$") that may be used to "hide" (e.g., cause the active switch 80 ("$M_{Pixel}$") to switch "OFF" or enter into the cutoff mode) during the time the display 18 is "ON," and will thus only cause the active switch 80 (e.g., "$M_{Pixel}$") to t turn an "ON" when a disturbance charge is detected or becomes apparent on the VCOM plate 64 (e.g., when the display 18 is "OFF"). Specifically, the active switch 82 (e.g., "$M_{Pixel}$") may be used to pull the voltage on the gate 84 of the active switch 80 (e.g., "$M_{Pixel}$") to t ground (e.g., approximately 0 V) or otherwise cause the active switch 80 (e.g., "$M_{Pixel}$") to act as an "open circuit" during the time the display 18 is "ON." In other embodiments, as will be further appreciated below, the active switch 80 (e.g., "$M_{Pixel}$") may be directly activated 1 by a voltage source (e.g., DC voltage source) 98.

Figure 10:
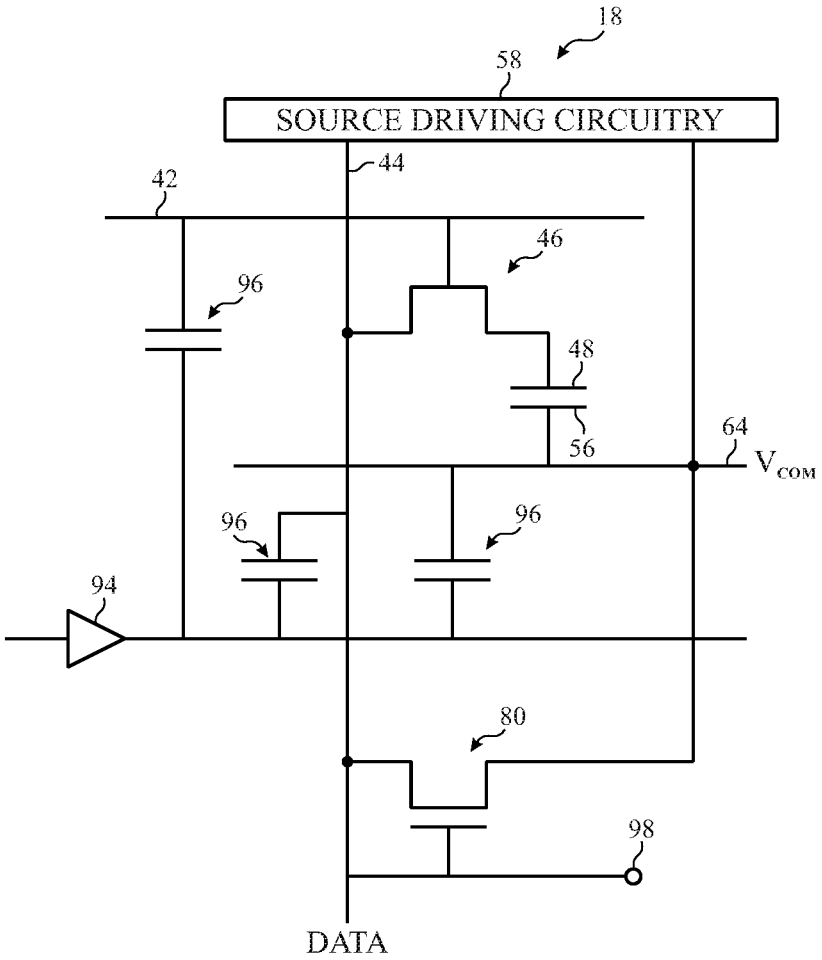
FIG. 10 is another equivalent circuit diagram illustrating of a unit pixel of the display of FIG. 1 including an active switch of FIG. 9, in accordance with an embodiment.

FIG. 10 illustrates an embodiment of a circuit diagram (e.g., equivalent circuit), in which the active switch 80 that may be used to discharge the VCOM plate 64 and/or the common electrode 56 is placed, for example, external to the unit pixel 40. Similarly, as discussed above with respect to FIG. 9, the active switch 80 may turn "ON" when a disturbance charge is detected or becomes apparent on the VCOM plate 64 (e.g., when the display 18 is "OFF").

Figure 11:
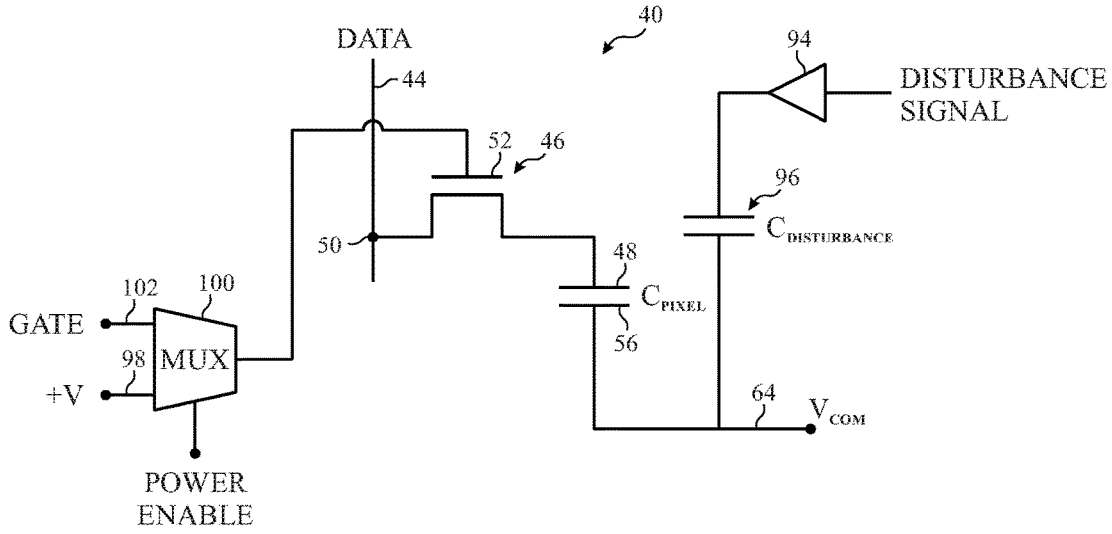
FIG. 11 is an equivalent circuit diagram illustrating of a unit pixel of the display of FIG. 1 including a multiplexer (MUX), in accordance with an embodiment.

FIG. 11 illustrates an embodiment of a circuit diagram (e.g., equivalent circuit) of a unit pixel 40 of the display 18 including, for example, a multiplexer (MUX) 100 that may be used to discharge the VCOM plate 64 and/or the common electrode 56. In one embodiment, the MUX 100 may be included as part of the unit pixel 40, or, in other embodiments, the MUX 100 may be included as part of the source driving circuitry 58. Yet still, in another embodiment, as will be further appreciated with respect to FIG. 13, the MUX 100 may operate as a standalone device within the display 18 used to control the operation of the TFT 46 regardless as to whether the display 18 is "ON" (e.g., active) or "OFF" (e.g., deactivated or temporarily inactive). As depicted, the pixel 40 may include a TFT 46, as previously discussed above with respect to FIGS. 7 and 9. The MUX 100 may include any selector device useful in selecting between a voltage signal 98 and a gate signal 102 to discharge any disturbance charge or other aberrant charge on the VCOM plate 64 and/or the common electrode 56 based on a selection input "Power Enable" signal.

In certain embodiments, as further depicted, the MUX 100 may be coupled to the gate 52 of the TFT 46 to control the TFT 46 to turn "ON" and "OFF." Specifically, when the "Power Enable" signal is logically low (e.g., when the display is "OFF"), the MUX 100 may provide the voltage signal 98 to the gate 52 of the TFT 46 to discharge the VCOM plate 64, such that any disturbance charge (e.g., due to a user touch or other disturbance) or other aberrant charge may be discharged to the data line 44. Otherwise, when the "Power Enable" signal is logically high (e.g., when the display is "ON"), the MUX 100 may provide the gate signal 102 to the gate 52 of the TFT 46. In this way, the possibility of image artifacts becoming apparent on the display 18 may be reduced or substantially eliminated.

Figure 12:
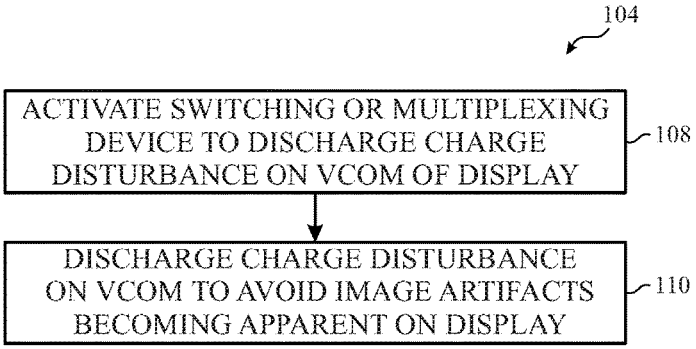
FIG. 12 is a flow diagram illustrating an embodiment of a process useful in discharging the VCOM of an electronic display, in accordance with an embodiment.

Turning now to FIG. 12, a flow diagram is presented, illustrating an embodiment of a process 104 useful in discharging the VCOM of an electronic display by using, for example, the one or more processor(s) 12 included within the system 10 depicted in FIG. 1 and/or the circuitry depicted in FIGS. 7, 9, and 11. The process 104 may include code or instructions stored in a non-transitory machine-readable medium (e.g., the memory 14) and executed, for example, by the one or more processor(s) 12 and/or the circuitry depicted in FIGS. 7, 9, and 11. The process 104 may begin with the one or more processor(s) 12 and/or other circuitry activating (block 108) a switching or multiplexing device to discharge a disturbance charge on the VCOM of the display. For example, the active switch 80 (e.g., "$M_{Pixel}$") and/or the MUX 100 may be used to discharge the VCOM plate 64, such that any disturbance charge 96 (e.g., "$C_{Disturbance}$") may be discharged to the data line 44. The process 104 may continue with the one or more processor(s) 12 and/or other circuitry (block 110) discharging the charge disturbance on VCOM to avoid image artifacts becoming apparent on the display. In this way, the possibility of image artifacts becoming apparent on the display 18 may be reduced or substantially eliminated.

Harvesting Energy from Aberrant Charge on VCOM

Figure 13:
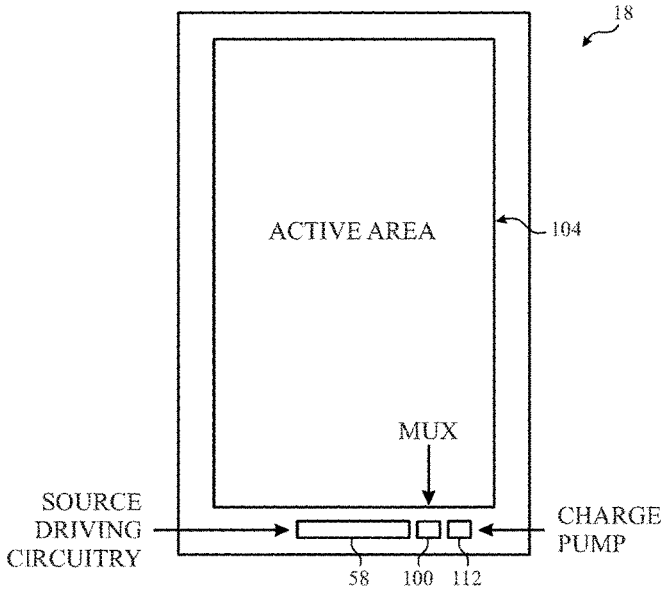
FIG. 13 is block diagram illustrating an alternative embodiment of the display of FIG. 1, in accordance with an embodiment.

FIG. 13 illustrates an alternative embodiment of the display 18. As illustrated in the present embodiment, the MUX 100 may be included as part of the display 18, but not as part of the source driving circuitry 58. Specifically, by including the MUX 100 separate from the source driving circuitry 58, as noted above with respect to FIG. 10, the MUX 100 may control the TFT 46 to turn "ON" and "OFF" regardless as to whether the display 18 itself is "ON" or "OFF." In some embodiments, as further depicted by FIG. 13, the display 18 may also include charge pump circuitry 112 or other DC to DC converter device (e.g., including buck, boost, and/or buck-boost circuitry) that may be used to harvest energy from any disturbance charge (e.g., as illustrated by the capacitance 96 ("$C_{Disturbance}$")) or other aberrant charge that may become present on the VCOM plate 64 during, for example, the time the display 18 is "OFF" (e.g., deactivated or temporarily inactive).

Figure 14:
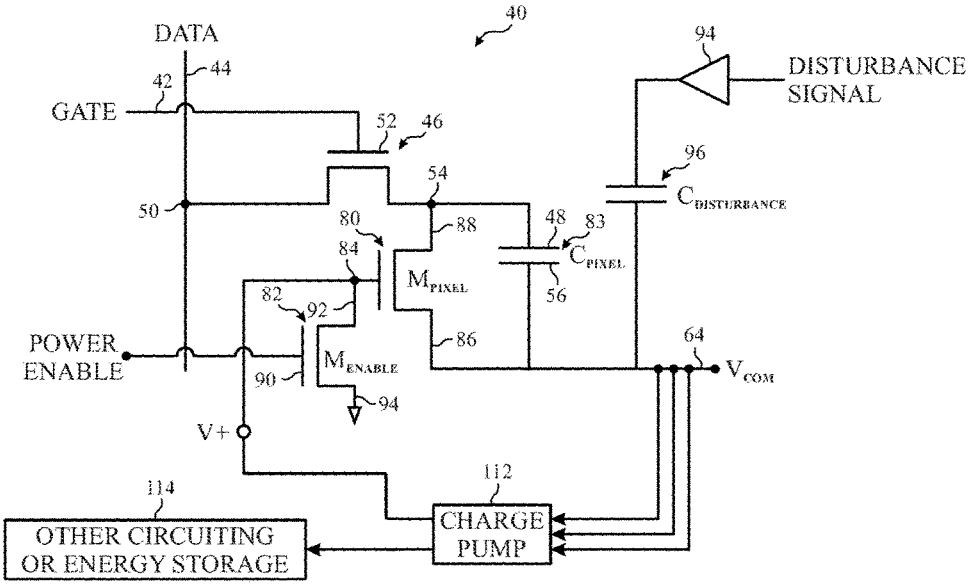
FIG. 14 is an equivalent circuit diagram illustrating a unit pixel of the display of FIG. 9 including charge pump circuitry, in accordance with an embodiment.

FIG. 14 illustrates an example of an embodiment of the circuit diagram (e.g., equivalent circuit) of the unit pixel 40 of the display 18 as discussed above with respect to FIG. 9 including the charge pump circuitry 112 for harvesting energy from the VCOM plate 64 and/or the common electrode 56. For example, in certain embodiments, the charge pump circuitry 112 may be coupled to the VCOM plate 64, and may, in some embodiments, receive a number of inputs from the VCOM plate 64 and/or the common electrode 56. In certain embodiments, the charge pump circuitry 112 may utilize the inputs from the VCOM plate 64 (e.g., based on a disturbance charge or the capacitance 96 ("$C_{Disturbance}$") on the VCOM plate 64) to generate one or more usable voltage signals. The usable voltage signals may be supplied to other circuitry or energy storage 114 (e.g., operational circuitry for the display 18 and/or electronic device 10 or a battery). In one embodiment, the charge pump circuitry 112 may also supply a voltage signal (e.g., a boosted voltage signal) based on a disturbance charge or the capacitance 96 ("$C_{Disturbance}$") to activate the active switch 80 (e.g., "$M_{Pixel}$") to discharge the VCOM plate 64. Thus, as previously noted with respect to FIG. 9, the active switch 80 (e.g., "$M_{Pixel}$") may turn "ON" only when a disturbance charge is detected or becomes apparent on the VCOM plate 64 and/or the common electrode 56 (e.g., when the display 18 is "OFF").

Figure 15:
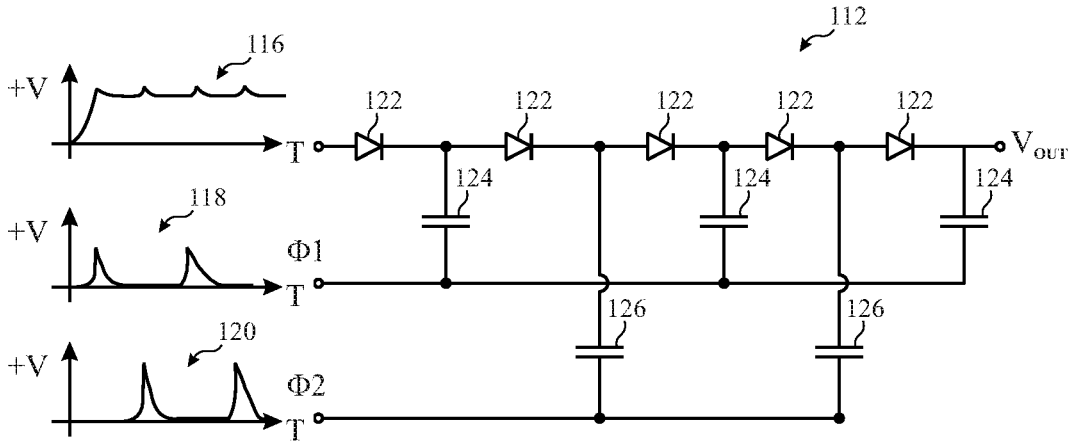
FIG. 15 illustrates an example of an embodiment of the charge pump circuitry of FIG. 13, in accordance with an embodiment.

FIG. 15 illustrates an example of an embodiment of the charge pump circuitry 112. In one embodiment, as depicted, the charge pump circuitry 112 may include a Dickson charge pump (e.g., multi-stage Dickson charge pump). However, in other embodiments, the charge pump circuitry 112 may be any of various charge pumps such as, for example, a voltage doubler charge pump, a static charge transfer switch (CTS) charge pump, a Cockcroft-Walton voltage multiplier charge pump, and so forth. In certain embodiments, as further depicted in FIG. 15, the charge pump circuitry 112 may receive an input voltage signal 116 ("$V_{In}$") and clock signals 118 and 120 ("$\phi_1$" and "$\phi_2$"), which may be out-of-phase with respect to each other.

In some embodiments, the input voltage signal 116 ("$V_{In}$") and the clock signals 118 and 120 ("$\phi_1$" and "$\phi_2$") may be generated based on, for example, a disturbance charge or the capacitance 96 ("$C_{Disturbance}$") detected or becoming apparent on the VCOM plate 64 and/or the common electrode 56. In another embodiment, the clock signals may also be generated from any combination of existing clock signals in the electrical system, including but not limited to the CPU clock, GPU clock, SoC clock, WLAN clock, Bluetooth clock, and memory clock. Similarly, the clock signals may also be generated from only one of these existing clock signals by passing that signal through an inverter or delay elements, including but not limited to capacitors, inductors, flip-flops, and transmission lines.

As further depicted, the charge pump circuitry 112 may include a number of diodes 122 (e.g., diode chain), which may be used as timing switches that may successively turn "ON." Indeed, during operation, the charge pump circuitry 112 may boost a charge along the number of diodes 122 (e.g., diode chain) while the capacitors 118 and 120 may be successively charged and discharged during each cycle of the clock signals 118 and 120 ("$\phi_1$" and "$\phi_2$"), respectively. As further depicted, and as will be better appreciated with respect to FIG. 19 below, the charge pump circuitry 112 may generate a useable voltage output signal ("$V_{Out}$") that may be provided to the other circuitry or energy storage 114 (e.g., operational circuitry or battery) to be used by the display 18 and/or electronic device 10.

Figure 16:
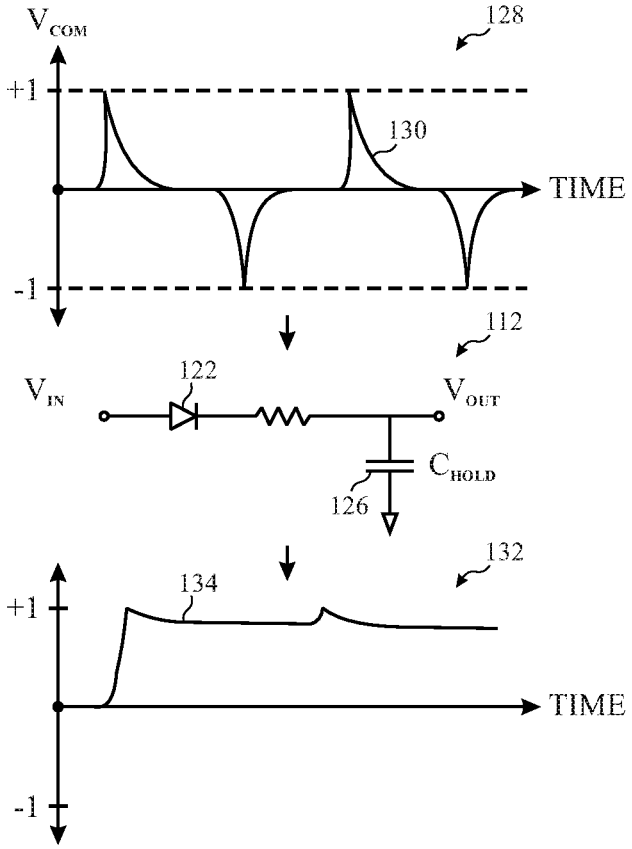
FIG. 16 illustrates an example of input and output voltage signals based on an aberrant charge on a VCOM, in accordance with an embodiment.
Figure 17:
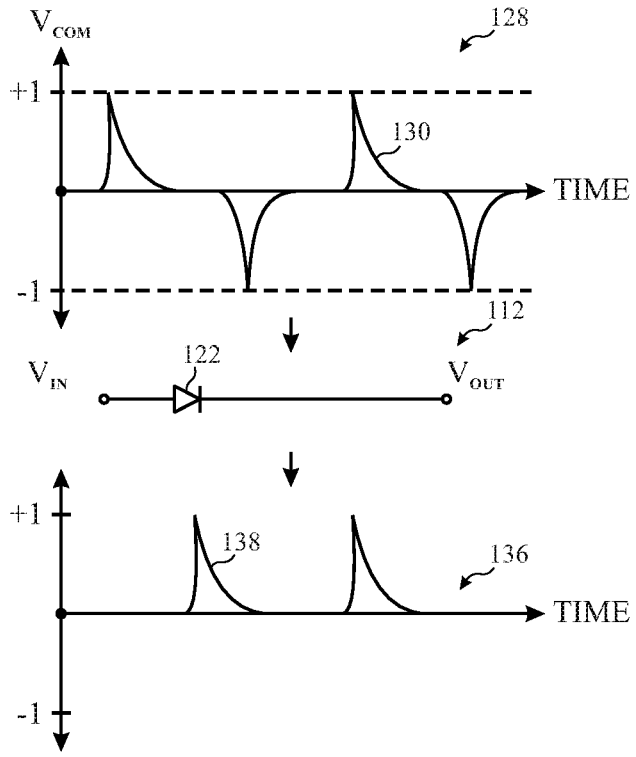
FIG. 17 illustrates an example of a clock signal based on an aberrant charge on a VCOM, in accordance with an embodiment.
Figure 18:
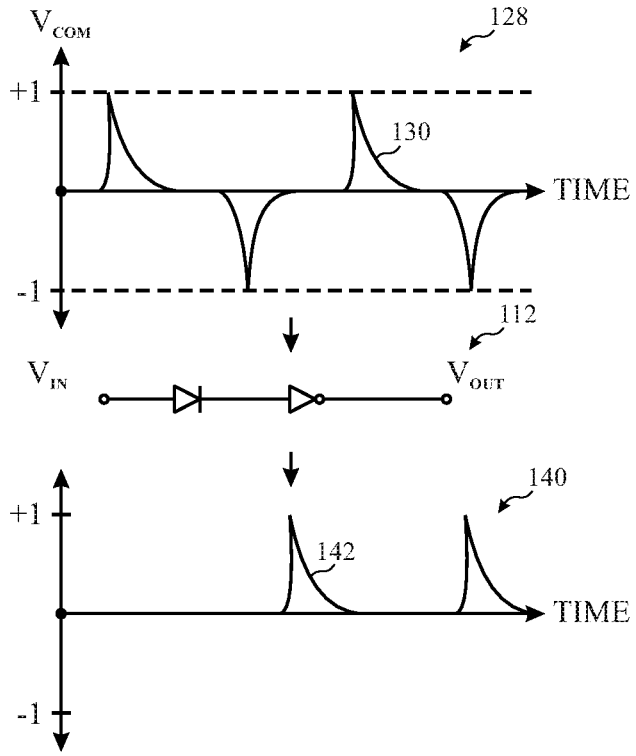
FIG. 18 illustrates another example of a clock signal based on an aberrant charge on a VCOM, in accordance with an embodiment.

FIGS. 16, 17, and 18 respectively illustrate examples of the input and output signals taken from the input voltage signal 116 ("$V_{In}$") and clock signals 118 and 120 ("$\phi_1$" and "$\phi_2$") generated by the charge pump circuitry 112. As depicted in FIG. 16, a plot 128 of a VCOM charge signal 130 may be input to the charge pump circuitry 112, and an output voltage signal 134 based on the input voltage signal 116 ("$V_{In}$") may be generated by the charge pump circuitry 112, as illustrated by the plot 132. For example, a DC input voltage signal 116 ("$V_{In}$") may be generated by the charge pump circuitry 112 rectifying disturbance charge signal on the VCOM plate 64 and passing the disturbance charge signal through a low pass filter, as illustrated.

Similarly, as depicted in FIG. 17, the VCOM charge signal 130 may be input to the charge pump circuitry 112, and an output voltage signal 138 based on the input clock signal 118 ("$\phi_1$") may be generated by the charge pump circuitry 112, as illustrated by the plot 136. For example, the input clock signal 118 ("$\phi_1$") may be generated by the charge pump circuitry 112 passing the disturbance charge signal on the VCOM plate 64 through a forward diode, as illustrated. Lastly, as depicted in FIG. 18, the VCOM charge signal 130 may be input to the charge pump circuitry 112, and an output voltage signal 142 based on the input clock signal 120 ("$\phi_2$") may be generated by the charge pump circuitry 112, as illustrated by the plot 140. For example, the input clock signal 120 ("$\phi_2$") may be generated by the charge pump circuitry 112 passing the disturbance charge signal on the VCOM plate 64 through a reverse diode in series with an inverter, as illustrated. Based on the input voltage signal 116 ("$V_{In}$"), the input clock signal 118 ("$\phi_1$"), and the input clock signal 120 ("$\phi_2$"), the charge pump circuitry 112 may generate, for example, a high DC voltage output signal $V_{out}$, which may be expressed as:

$$V_{out}=k*V_{In}, \text{ where } k \text{ is a constant}>1.$$

Figure 19:
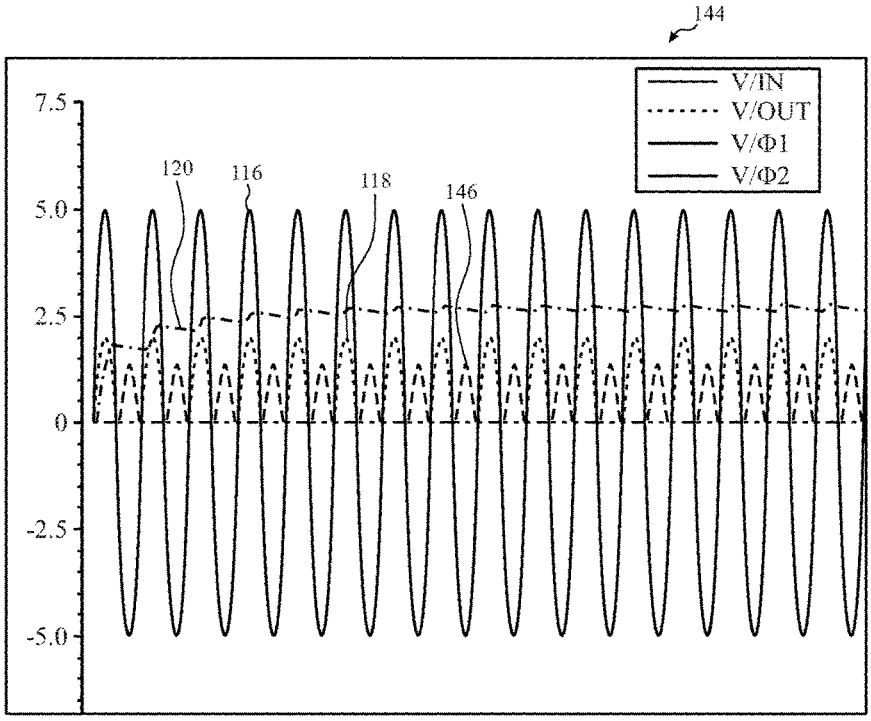
FIG. 19 is a graph illustrating the simulation of a display employing techniques of harvesting energy from the VCOM of an electronic display.

As a further example, FIG. 19 illustrates an example simulation plot 144 (e.g., real-world simulation) of the operation of the charge pump circuitry 112. As illustrated, the charge pump circuitry 112 may generate a useable and/or storable output voltage signal ("$V_{Out}$") 146 based on, for example, the input voltage signal 116 ("$V_{In}$") and the clock signals 118 and 120 ("$\phi_1$" and "$\phi_2$") taken from a disturbance charge or other aberrant charge that may become apparent on the VCOM plate 64. As previously noted above, the output voltage signal ("$V_{Out}$") 146 may be provided to the other circuitry or energy storage 114 (e.g., operational circuitry or battery) to be used by the display 18 and/or electronic device 10. Otherwise, the output voltage signal 146 may be supplied to the active switch 80 (e.g., "$M_{Pixel}$") and/or the MUX 100 to discharge the VCOM plate 64 when the display 18 is "OFF" (e.g., deactivated or temporarily inactive).

Figure 20:
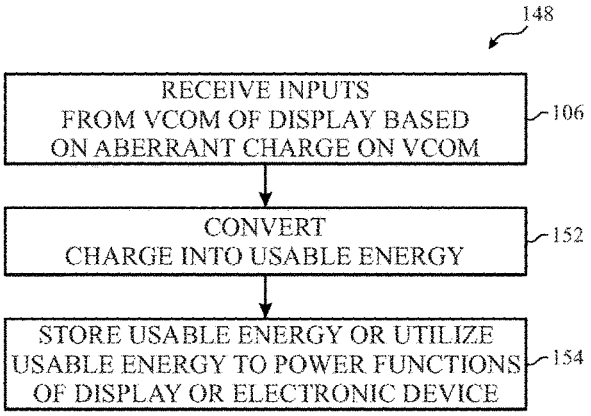
FIG. 20 is a flow diagram illustrating an embodiment of a process useful in harvesting energy from the VCOM of an electronic display, in accordance with an embodiment.

Turning now to FIG. 20, a flow diagram is presented, illustrating an embodiment of a process 148 useful in harvesting energy from the VCOM of an electronic display by using, for example, the one or more processor(s) 12 included within the system 10 depicted in FIG. 1 and/or the charge pump circuitry 112 depicted in FIGS. 14 and 15. The process 104 may include code or instructions stored in a non-transitory machine-readable medium (e.g., the memory 14) and executed, for example, by the one or more processor(s) 12 and/or the charge pump circuitry 112 depicted in FIGS. 14 and 15.

The process 148 may begin with the one or more processor(s) 12 and/or other the charge pump circuitry 112 receiving (block 150) a number of inputs from the VCOM of a display based on an aberrant charge on the display. For example, the charge pump circuitry 112 may receive the input voltage signal 116 ("$V_{In}$"), the input clock signal 118 ("$\varphi_1$"), and the input clock signal 120 ("$\varphi_2$"). The process 148 may continue with the one or more processor(s) 12 and/or the charge pump circuitry 112 converting (block 152) the inputs into a useable or storable voltage, current, and/or energy in the form of electric and/or magnetic fields. The process 148 may conclude with the one or more processor(s) 12 and/or the charge pump circuitry 112 storing (block 154) the usable voltage, current, and/or energy or utilizing the useable voltage and/or energy to power functions of the display or the electronic device including the display. For example, the charge pump circuitry 112 may generate an output voltage signal ("$V_{Out}$") 146 that may be provided to the other circuitry or energy storage 114 (e.g., operational circuitry, a battery, or an inductor) to be used by the display 18 and/or electronic device 10.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A method, comprising:

while an electronic display is deactivated from displaying images, supplying an activation signal, via a voltage source, to an active switching device of the electronic display, wherein the active switching device is configured to discharge an aberrant charge on a common electrode of the electronic display; and discharging the aberrant charge by way of the active switching device, wherein discharging the aberrant charge comprises preventing a possible occurrence of image artifacts from becoming apparent on the electronic display.

2. The method of claim 1, wherein supplying the activation signal to the active switching device comprises activating the active switch to allow the aberrant charge to flow from the common electrode to a data line of the electronic display.

3. The method of claim 1, wherein supplying the activation signal to the active switching device comprises supplying the activation signal to a transistor coupled to the common electrode.

4. The method of claim 1, wherein supplying the activation signal to the active switching device comprises supplying a signal to a multiplexer coupled to a gate of a transistor of the electronic display configured to supply an image data signal to a pixel electrode of the electronic display.

5. The method of claim 1, wherein discharging the aberrant charge by way of the active switching device comprises discharging a disturbance charge on the common electrode based on a user touch of the electronic display or electromagnetic interference (EMI).

6. The method of claim 1, comprising supplying image data to a pixel electrode of the electronic display when the electronic display is in an on state.

7. The method of claim 1, wherein the electronic display comprises:

gate driving circuitry transmitting a first signal to a first transistor when the electronic display is in an activated state and transmitting a second signal to the first transistor when the display panel is in a deactivated state, wherein the first signal is configured to cause the first transistor to activate to supply image data to a pixel electrode of the electronic display, and wherein the second signal is configured to cause the first transistor to activate to discharge a common electrode of the electronic display; or source driving circuitry transmitting a third signal to the first transistor when the electronic display is in the activated state and transmitting a fourth signal to a second transistor when the electronic display is in the deactivated state, wherein the third signal is configured to cause the first transistor to supply the image data to the pixel electrode, and wherein the fourth signal is configured to activate the second transistor to discharge the common electrode.

8. An electronic device, comprising:

a display panel, comprising:

gate driving circuitry configured to transmit a first signal to a first transistor when the display panel is in an activated state and to transmit a second signal to the first transistor when the display panel is in a deactivated state, wherein the first signal is configured to cause the first transistor to activate to supply image data to a pixel electrode of the display panel, and wherein the second signal is configured to cause the first transistor to activate to discharge a common electrode of the display panel; or source driving circuitry configured to transmit a third signal to the first transistor when the display panel is in the activated state and to transmit a fourth signal to a second transistor when the display panel is in the deactivated state, wherein the third signal is configured to cause the first transistor to supply the image data to the pixel electrode, and wherein the fourth signal is configured to activate the second transistor to discharge the common electrode.

9. The electronic device of claim 8, wherein the gate driving circuitry comprises a multiplexer (MUX) coupled to a gate of the first transistor, and wherein the MUX is configured to select between a gate signal as the first signal and a voltage source signal as the second signal.

10. The electronic device of claim 8, wherein the second transistor is coupled to the first transistor via a first terminal of the second transistor.

11. The electronic device of claim 10, wherein the second transistor is coupled to the common electrode via a second terminal of the second transistor.

12. The electronic device of claim 8, wherein the second signal is configured to cause the first transistor to activate to discharge a disturbance charge on the common electrode when the display panel is in the deactivated state for displaying images.

13. The electronic device of claim 8, wherein the fourth signal is configured to activate the second transistor to discharge a disturbance charge on the common electrode when the display panel is in the deactivated state for displaying images.

14. A method, comprising:

receiving one or more inputs from a common electrode of an electronic display based on an aberrant charge on the common electrode;

converting the one or more inputs based on the aberrant charge into a useable energy utilizing a charge pump, boost circuitry, buck circuitry, buck-boost circuitry, or a rectifier to convert the one or more inputs into a direct current (DC) output voltage signal; and storing or utilizing the useable energy to power one or more functions of the electronic display.

15. The method of claim 14, wherein receiving the one or more inputs from the common electrode comprises receiving the one or more inputs when the electronic display is in an off state for displaying images.

16. The method of claim 14, wherein receiving the one or more inputs from the common electrode comprises receiving a voltage input, a first clock signal, and a second clock signal each generated based on the aberrant charge or an electronic display clock signal.

17. The method of claim 14, comprising discharging the aberrant charge, wherein discharging the aberrant charge comprises preventing a possible occurrence of image artifacts from becoming apparent on the electronic display.

18. The method of claim 14, wherein the electronic display comprises:

gate driving circuitry transmitting a first signal to a first transistor when the electronic display is in an activated display state and transmitting a second signal to the first transistor when the display panel is in a deactivated display state, wherein the first signal is configured to cause the first transistor to activate to supply image data to a pixel electrode of the electronic display, and wherein the second signal is configured to cause the first transistor to activate to discharge the common electrode of the electronic display; or source driving circuitry transmitting a third signal to the first transistor when the electronic display is in the activated display state and transmitting a fourth signal to a second transistor when the electronic display is in the deactivated display state, wherein the third signal is configured to cause the first transistor to supply the image data to the pixel electrode, and wherein the fourth signal is configured to activate the second transistor to discharge the common electrode.

19. The method of claim 14, wherein the electronic display comprises:

source driving circuitry providing a pixel data signal to a pixel electrode of the electronic display when the electronic display is in an on state for displaying images;

charge pump circuitry coupled to the common electrode of the electronic display and generating a voltage source signal based on the aberrant charge accumulated on the common electrode when the electronic display is an off state for displaying images; and a selector device providing a gate signal to a gate of a thin-film transistor (TFT) coupled to the pixel electrode when the electronic display is in the on state and to provide the voltage source signal to the gate of the TFT when the electronic display is in the off state.

20. An electronic device, comprising:

a display panel, comprising:

source driving circuitry configured to provide a pixel data signal to a pixel electrode of the display panel when the display panel is in an on state;

charge pump circuitry coupled to a common electrode of the display panel and configured to generate a voltage source signal based on a disturbance charge accumulated on the common electrode when the display panel is in an off state; and a selector device configured to provide a gate signal to a gate of a thin-film transistor (TFT) coupled to the pixel electrode when the display panel is in the on state and to provide the voltage source signal to the gate of the TFT when the display panel is in the off state.

21. The electronic device of claim 20, wherein the selector device is configured to provide the voltage source signal to the gate of the TFT to discharge the disturbance charge accumulated on the common electrode.

22. The electronic device of claim 20, wherein the selector device and the charge pump circuitry are configured to be operable when the display panel is in the on state and when the display panel is in the off state for displaying images.

23. The electronic device of claim 20, wherein the charge pump circuitry is configured to provide the voltage source signal to the selector device, functional circuitry of the electronic device, storage circuitry of the electronic device, or any combination thereof.

24. A display panel, comprising:

a pixel, including:

a pixel electrode;

a common electrode;

a first transistor having a source coupled to a data line, a first gate coupled to a gate line, and a drain coupled to the pixel electrode, wherein the first transistor is configured to pass a data signal from the data line to the pixel electrode upon receipt of an activation signal from the gate line; and a second transistor having a first terminal coupled to the drain of the first transistor, a second terminal coupled to the common electrode, and a second gate coupled to a voltage source or a current source, wherein the second transistor is configured to discharge an aberrant charge on the common electrode, wherein the voltage source or the current source is generated based on the aberrant charge on the common electrode.

25. The display panel of claim 24, wherein the second transistor is configured to discharge the aberrant charge on the common electrode when the display panel is temporarily inactive from displaying images.

26. The display panel of claim 24, wherein the second transistor is configured to discharge the aberrant charge on the common electrode by allowing the aberrant charge to flow from the common electrode to the data line.

27. The display panel of claim 24, comprising a third transistor having a first terminal coupled to the second gate of the second transistor, wherein the third transistor is configured to control an activation or a deactivation of the second transistor.

28. The display panel of claim 27, wherein third transistor is configured to control the second transistor to activate when the display panel is active and to deactivate when the display panel is temporarily inactive from displaying images.

29. The electronic device of claim 24, wherein the discharge of the aberrant charge on the common electrode prevents a possible occurrence of image artifacts from becoming apparent on the display panel.

30. The electronic device of claim 24, wherein the display panel further comprises:

source driving circuitry configured to provide the data signal to the pixel electrode of the display panel when the display panel is in an on state;

charge pump circuitry coupled to the common electrode of the display panel and configured to generate a voltage source signal based on the aberrant charge accumulated on the common electrode when the display panel is in an off state; and a selector device configured to provide the activation signal to a gate of a thin-film transistor (TFT) coupled to the pixel electrode when the display panel is in the on state and to provide the voltage source signal to the gate of the TFT when the display panel is in the off state.

* * * * *